United States Patent [19]

Weaver et al.

[11] Patent Number: 4,510,879

[45] Date of Patent: Apr. 16, 1985

[54] ANTI-CAVITATION RUDDER BLADE

[76] Inventors: Richard T. Weaver, 6881 Circle Creek Dr., Pinellas Park, Fla. 33565; Gregory A. Weaver, 136 Arlington Ave., Oldsmar, Fla. 33557

[21] Appl. No.: 425,320

[22] Filed: Sep. 28, 1982

[51] Int. Cl.[3] ..... B63H 25/38

[52] U.S. Cl. ..... 114/162

[58] Field of Search ..... 416/91; 114/162, 288, 114/274, 275, 276, 277, 126, 127, 140, 166, 171, 172, 141-143; 244/208, 209, 219; 440/76

[56] References Cited

U.S. PATENT DOCUMENTS 3,360,221 12/1967 Heskestad ..... 244/208

3,680,511 8/1972 English ..... 114/162

*Primary Examiner*—Sherman D. Basinger

*Attorney, Agent, or Firm*—Ronald E. Smith

[57] ABSTRACT

A rudder blade means of the type designed to reduce the drag produced by rudder blades of conventional design. The novel design, having utility in any vessel that travels through a fluid medium and incorporates a substantially vertically aligned chamber formed internally of the rudder body. The chamber has a narrow, slot-like portion that is in open communication with the trailing edge of the rudder body, and an enlarged, bore-like portion remote from said trailing edge but in open communication with the innermost portion of said slot-like portion. In applications where the rudder body is mounted to a sea-going vessel, and wherein such rudder body has a submerged portion and an un-submerged portion, water enters the chamber, in a counterswirling pattern, through the slot-like portion, and is driven upwardly, by water pressure, through the bore-like portion and is expelled above the water line through the uppermost region of said slot-like portion of such chamber.

3 Claims, 4 Drawing Figures

ANTI-CAVITATION RUDDER BLADE

BACKGROUND OF THE INVENTION

1. Field of the Invention

This invention relates, generally, to an improvement in rudder blade performance, and more specifically relates to an improvement designed to alleviate the effects of disturbed laminar flow arising from cavitation.

2. Description of the Prior Art

A search of United States patents that was conducted prior to the filing of this disclosure located the following patents in the general field of this invention:

| Patentee | U.S. Pat. No. | Date ot Issue |
|---|---|---|
| Mello | 2,961,987 | 11-29-60 |
| Hill et. al. | 3,326,296 | 06-20-67 |
| Lane | 3,452,701 | 07-01-69 |
| Yuan | 3,472,192 | 10-14-69 |
| English | 3,680,511 | 08-01-72 |

The field of search included Class/sub-class 114/162, 126, 122 and 66.5.

Clearly, considerable effort has been expended by inventors in efforts to produce rudder blade designs having operating characteristics superior to the conventional rudder blade designs. Although the earlier designs may have utility in their intended area of application, a rudder blade design that reduces cavitation to negligible amounts does not appear in the prior art.

SUMMARY OF THE INVENTION

The longstanding but heretofore unfulfilled need for a rudder blade design that overcomes the limitations of the constructions of the prior art is now fulfilled in the form of a rudder blade construction characterized by a chamber formed interiorly of the rudder body that extends substantially the entire height of the rudder body and which chamber is in fluid communication with the water flowing past the rudder.

More specifically, the chamber has a narrow, slot-like opening formed in coincidence with the trailing edge of the rudder body. The slot-like opening merges with an enlarged, bore-like opening that tapers from its innermost portion to its outermost portion in correspondence with the taper formed in the rudder body itself, i.e., the enlarged bore-like portion of the chamber narrows as it approaches the slot-like portion of the chamber.

When the inventive construction, which is believed to have utility in the context of any vessel moving through a fluid medium, is conventionally mounted on a sea-going vessel such as a catamaran, the major portion of the rudder body will be submerged, and a minor portion thereof will be above the water line. In theory, forward travel of the vessel will cause counter-swirling vortexes to form at the trailing edge of the rudder. The energy in these counter-swirling vortexes is inventively harnessed in a productive, cavitation-reducing manner. However, in conventional constructions, laminar flow interruptions encountered during times of angle of attack changes or excessive speed impinge upon the rudder body and thereby produce the well known effects of speed-reducing cavitation.

Specifically, a low pressure zone created by the movement of the rudder through water creates counter-rotating vortexes which enter the bore-like portion of the novel rudder through the narrow slot-like opening.

As internal slot water pressure increases all along the submerged slot, the water entering the rudder chamber will be hydraulically propelled upwardly. The water travels upwardly through the bore-like portion of the chamber and exhausts therefrom, above the water line, through the un-submerged portion of the slot-like portion of the chamber. This exhaust process may impart a minimal jet-like thrust to the vessel, in that the rearwardly-directed expulsion of the water from the inventive chamber has its counterpart in an oppositely directed force which propels the vessel forward.

It is therefore seen that the primary object of this invention is to improve rudder blade performance and maintain laminar flow to a greater degree of efficiency.

A more particular object is to provide a rudder blade design that productively and advantageously harnesses the energy residing in the swirling vortexes produced by the inventive slotted rudder near the trailing edges thereof.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 2:
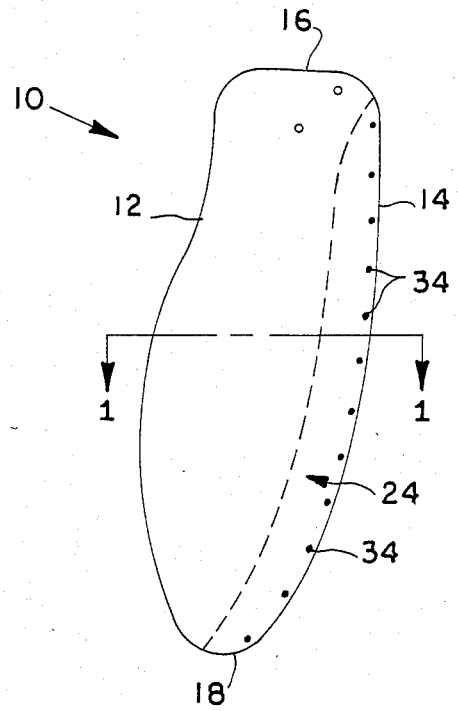
FIG. 2 is a side elevational view of the novel rudder means, showing the inventive chamber in phantom lines.

Referring first to FIG. 2, it will there be seen that a rudder construction that is illustrative of the inventive concept is indicated by the reference numeral 10 as a whole. The rudder body 10 has a generally vertically aligned leading edge 12, a trailing edge 14 disposed in co-planar and substantially parallel relation to such leading edge 12, a generally flat upper edge 16, and an arcuate lower edge 18. Of course, rudder constructions vary widely in configuration, and the novel concept is not limited to the illustrative rudder design shown in the drawings.

Figure 1:
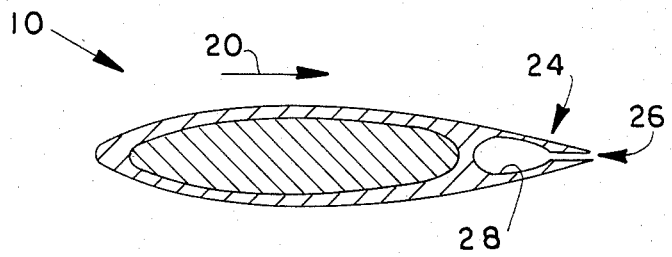
FIG. 1 is a transverse sectional view of the novel rudder means, taken along line 1—1 of FIG. 2.
Figure 4:
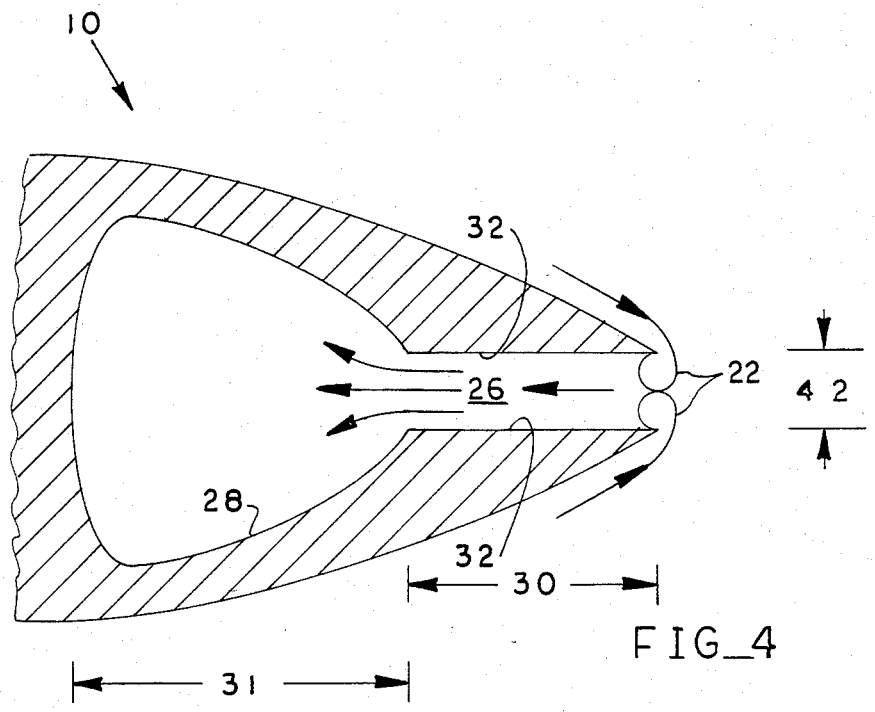
FIG. 4 is an enlarged, partial view of the novel rudder, similar to the view of FIG. 1, but showing the path of water flow around the novel rudder means and into the chamber formed therein.

When the novel rudder construction 10 is seen in transverse section, as in FIG. 1, it is seen that it has a conventional, generally tear-drop shape. This shape maintains a laminar flow pattern over the rudder blade body when fluid flows in the direction indicated by the single-headed directional arrow 20. As best seen in FIG. 4, counter-swirling vortexes, indicated as 22 in that Figure, appear at the trailing edge 14 of the rudder 10. Uncontrollable cavitation appears in the same location of conventional rudders during periods of excessive speed and/or angle of attack changes and is believed to be a primary source of drag. The inventive construction harnesses the energy of these vortexes 22 in a constructive manner, as will become clear as this description proceeds.

Returning now to FIGS. 1 and 2, it will there be seen that a chamber means, generally designated 24, is formed in the rudder means 10 and extends, in the particular embodiment under discussion, from a point just downwardly of the uppermost edge 16 of the rudder blade 10 to a point at the lowermost region of the leading edge 12. The chamber means 24, which renders hollow the portion of the rudder 10 adjacent the trailing edge 14, is composed of a slot-like portion 26 and an enlarged bore-like portion 28. The slot-like portion 26 is in open communication with the water, as best shown in FIG. 4, and preferably has a length, or depth 30 that is substantially equal to half the length, or depth 31, of the bore portion 28. The bore portion 28, being in fluid communication with the slot portion 26, is thus also in fluid communication with the water.

The dimensions of the slot 26 are substantially uniform along its height, i.e., the distance between the flat facing walls 32 (FIG. 4) that are cooperatively positioned to define the slot 26 does not vary substantially along the height of the slot 26. This spacing is maintained by a plurality of generally horizontally aligned, equidistantly spaced rigid spacer members, indicated collectively in FIG. 2 by the reference numeral 34.

The contour of the bore 28 follows the outer contour of the rudder 10, i.e., the bore 28 tapers downwardly as it extends from its widest, innermost portion to its narrowest, slot-adjoining innermost portion, as is clearly shown in FIGS. 1 and 4.

Figure 3:
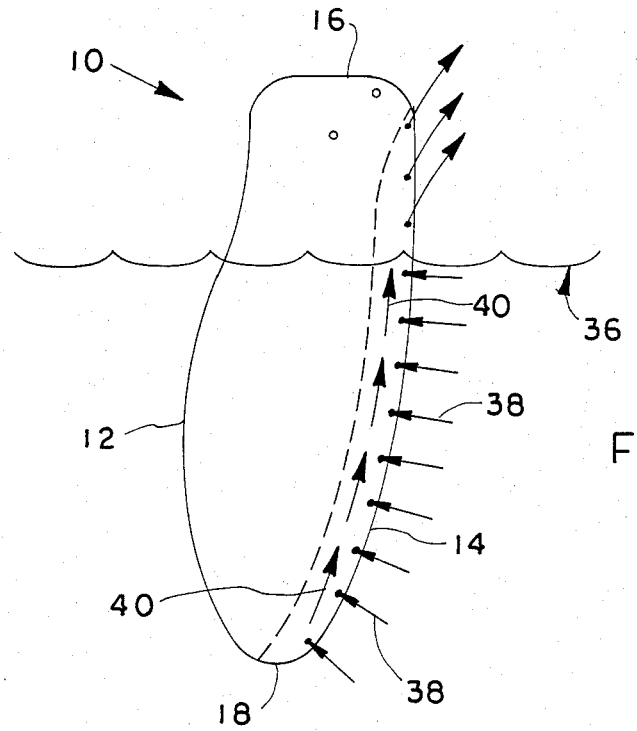
FIG. 3 is a side elevational view of the novel rudder means, similar to the view of FIG. 2, but showing the same partially immersed in a body of water and showing the flow of water through the inventive chamber formed in the novel rudder means.

The operation of the inventive rudder 10 is clearly shown in FIG. 3. Water 36 enters the submerged portion of the slot 26 as indicated by the arrows bearing reference numerals 38. The pressure of the water within the bore chamber 28 drives such water upwardly through bore 28 as indicated by the arrows bearing reference numerals 40. The water surging upwardly through the bore 28 follows the path of least resistance, which path leads to the un-submerged portion of the rudder 10. Accordingly, the kinetic energy acquired by the water is released as the water escapes from bore 28 through the un-submerged portions of slot 26, which rearwardly-directed action may aid in the forward propulsion of the vessel.

Field tests of the inventive construction, conducted on a catamaran, have shown that the inventive construction reduces drag by considerable amounts, in comparison to conventional rudder blades and, in racing situations, a boat equipped with the novel rudder blade 10 should have a considerable advantage, particularly in maneuverability, over conventionally-equipped boats. The primary source of extra speed and enhanced maneuverability is the elimination of the deleterious effects of cavitation which forms in the wake of the rudder blade 10 during periods of excessive speed and/or angle of attack changes. As best understood in connection with FIG. 4, the width 42 of the slot 26 must be sufficient to permit the counter-swirling vortexes 22 to enter into the bore 28. The water, being admitted into the chamber 24, thus is not given the opportunity to cavitate externally and disrupt laminar flow as happens in the absence of the inventive improvements. Such impingement creates drag, and the inventive construction both eliminates such wasteful impingement and harnesses the power of the water that would have otherwise dissipated its energies destructively.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, that which is claimed is:

1. An apparatus for steering a boat through water, comprising, a rudder means, said rudder means operatively mounted to said boat and operable to steer said boat, said operatively mounted rudder means having an upper portion and a lower portion, the upper portion of said rudder means being disposed generally out of contact with said water when said boat is under way, the lower portion of said rudder means being generally submerged within said water when said boat is under way, said rudder means provided with passive maneuverability enhancing means operated by passage of the boat through water, said rudder means provided with a hollow interior, said passive maneuverability enhancing means including means to allow water to gain entrance into the interior of said rudder means, below the water line, when said boat is under way and to allow said water to be discharged, subsequent to said entrance, from said rudder means above the water line, said passive maneuverability enhancing means including a vertically disposed bore means formed interiorly of said rudder means, said bore means disposed in fluid communication with a major portion of the trailing edge of said rudder means, said bore means extending from the lower end of said rudder means to a position downwardly of the upper end thereof, said bore configured to admit water thereinto on a continuous basis when said boat is under way and to discharge water therefrom above the water line to thereby enhance the maneuverability of said boat, said discharge of said water imparting a center line thrust to the rudder means.

2. The apparatus of claim 1, wherein said bore means includes an enlarged portion spaced inwardly from said trailing edge of said rudder means and a narrower slot-like portion disposed between said enlarged portion and said trailing edge and providing fluid communication therebetween.

3. The apparatus of claim 2, wherein water adjacent the trailing edge of said rudder forms counterswirling vortexes at said trailing edge as a result of a low pressure zone formed by passage of the rudder means through the water, and wherein said water follows an upwardly directed path of travel interiorly of said rudder means, entering said enlarged bore below the water line, traveling upwardly therethrough, and exiting in a rearward direction therefrom above the water line, said path of travel being dictated by said bore means.

* * * * *